US005601483A

United States Patent [19]

Rudolf et al.

[11] Patent Number: 5,601,483

[45] Date of Patent: Feb. 11, 1997

[54] POWER TOOL

[75] Inventors: Boris Rudolf, Stuttgart; Walter Blutharsch, Sindelfingen; Andreas Peisert; Thomas Veit, both of Stuttgart, all of Germany

[73] Assignee: C. & E. Fein GmbH & Co., Stuttgart, Germany

[21] Appl. No.: 323,396

[22] Filed: Oct. 14, 1994

[30] Foreign Application Priority Data

Oct. 27, 1993 [DE] Germany ..... 43 36 620.1

[51] Int. Cl.[6] ..... B24B 41/04

[52] U.S. Cl. ..... 451/359; 451/342; 451/344

[58] Field of Search ..... 951/342, 344, 951/353, 359

[56] References Cited

U.S. PATENT DOCUMENTS

| | | | |
|---|---|---|---|
| 4,434,586 | 3/1984 | Muller et al. . | |
| 4,735,020 | 4/1988 | Schulz et al. . | |
| 4,989,374 | 2/1991 | Rudolf et al. . | |
| 5,022,188 | 6/1991 | Borst | 451/342 |
| 5,157,873 | 10/1992 | Rudolf et al. | 451/342 |
| 5,259,145 | 11/1993 | Fushiya et al. | 451/342 |
| 5,263,283 | 11/1993 | Rudolf et al. | 451/342 |
| 5,464,365 | 11/1995 | Kirn | 451/359 |

FOREIGN PATENT DOCUMENTS

| | | |
|---|---|---|
| 3001907 | 7/1981 | Germany . |
| 4130174A1 | 3/1993 | Germany . |
| 9302807U1 | 7/1993 | Germany . |

*Primary Examiner*—Willis Little
*Assistant Examiner*—Eileen Morgan
*Attorney, Agent, or Firm*—Barry R. Lipsitz

[57] ABSTRACT

A power tool, which is preferably configured as a right-angle grinder, has a motor-driven hollow spindle to drive a tool, which is fastened between a clamping flange and a counterflange by means of a quick clamping device via a tension spindle, coaxial with the hollow spindle, that is tensioned in the axial direction by means of elastic elements and is displaceable in the axial direction relative to the hollow spindle, by means of a clamping lever, between a clamped position in which the tool is nonrotatably retained between the flanges, and a released position. The clamping lever is mechanically coupled to the motor switch by means of a link rod in such a way that the clamping lever can be moved into the released position only when the motor is switched off. This rules out improper operation and any potential damage to the power tool.

15 Claims, 2 Drawing Sheets

POWER TOOL

BACKGROUND OF THE INVENTION

The present invention relates to a power tool, in particular a right-angle grinder, with a hollow spindle driven by a motor and a quick clamping device to receive a tool between a clamping flange and a counterflange, such that the quick clamping device has a tension spindle, coaxial with the hollow spindle, that is tensioned in the axial direction by means of elastic elements and is displaceable in the axial direction relative to the hollow spindle, by means of a clamping lever, between a clamped position in which the tool is nonrotatably retained between the flanges, and a released position in which the flanges are disengaged in the axial direction for manual changing of the tool; and with a switch to actuate the motor.

RELATED PRIOR ART

A power tool of this kind is known from EP 0 319 813 B1. In the known machine the motor switch can be switched on or off regardless of the position of the clamping lever. But since the hollow spindle is additionally locked when the clamping lever is in the released position in order to allow easy manual changing of the tool in the released position, inadvertent activation of the motor in this position could lead to damage to the motor or the quick clamping device. To exclude such damage, the locking system, which preferably consists of claws which engage into corresponding depressions, is designed so that the claws, because of their oblique guiding edges, slide out of the depressions and thus release the locking system.

Although immediate damage to the motor or the quick clamping device is avoided in this manner, there nevertheless exists the danger of damage in the event of incorrect operation. Moreover, activation of the motor when the quick clamping device is open would quickly lead to wear on the claws and additionally to a rattling noise when they slide out over the depressions.

In an alternative embodiment according to EP 0 319 813 B1, provision is made to lock the hollow spindle by frictional engagement when the clamping lever is released. If the motor switch is switched on in this position to actuate the motor, this leads to rotation of the hollow shaft, while braking simultaneously occurs due to frictional engagement.

Here again, the risk of damage due to incorrect operation is not excluded, and in addition there is exists the danger of welding at the friction surfaces if the motor is not switched on only for a short period.

SUMMARY OF THE INVENTION

The object of the invention thus consists in improving a power tool of the aforesaid kind in such a way that the risk of damage during incorrect operation is reduced.

According to the invention, this object is achieved by the fact that in a power tool of the aforesaid kind, the clamping lever is mechanically coupled to the switch by means of a link rod in such a way that the clamping lever can be moved into the released position only when the motor is switched off.

According to the invention, a mechanical interlock, by means of a link rod between clamping lever and switch, thus prevents the clamping lever from being moved into the released position when the motor is switched on.

Thus firstly, release of the tool while the motor is switched on, by opening the quick clamping device, is effectively prevented, thus eliminating accidents from this cause. In addition, damage to the power tool caused by opening the clamping lever while the motor is switched on is also prevented.

According to the invention this is achieved by means of a mechanical interlock, since it has been found that an electrical lockout to switch off the motor—for example by means of a button switch that is opened to interrupt the flow of current when the clamping lever is moved into the released position—is too complex and too bulky because of the need to design for switching under full-load conditions.

Moreover, all that can be achieved with an electrical lockout is to switch off the motor when the clamping lever is opened. With this, however, there is a certain residual risk that release of the tool might not be completely excluded if the clamping lever were opened while the tool was still coasting.

In a preferred development of the invention, the clamping lever is also mechanically coupled to the switch, by means of the link rod, in such a way that the switch can be actuated to switch on the motor only when the clamping lever is in the clamped position.

The advantage of this feature is that the other instance of incorrect operation is also reliably eliminated, i.e. excluding the possibility of switching on the motor if the tool is not yet completely clamped.

In a further preferred embodiment of the invention, the link rod to actuate the switch is arranged displaceably between an activated position and a deactivated-position in the lengthwise direction of the link rod, which is preferably perpendicular to the axial direction; and at least one interlock element, which in the activated position is interlocked with a counterelement, is arranged between link rod and clamping lever.

The advantage of this feature is that the switch can easily be switched on and off by displacing the link rod in the lengthwise direction; simultaneously, interlocking with the clamping lever is achieved so that the latter cannot be actuated when the motor is switched on.

In a further embodiment of the invention, the clamping lever is pivotably mounted at a first end about a pivot axis and has an eccentric element which acts via a pusher stud on a pusher element in order to displace the tension spindle in the axial direction between the clamped position and released position as the clamping lever pivots.

The result of this known feature is to allow rapid, reliable clamping of the tool in the quick clamping device with no need for an additional tool for the purpose.

In an additional development of the embodiment just mentioned, the first end of the clamping lever has at least a first recess into which a projection of the link rod can be inserted in the lengthwise direction to interlock the clamping lever in the clamped position.

This guarantees, in a particularly simple manner, interlocking of the clamping lever to prevent movement from the clamped position into the released position, and to prevent actuation of the switch to switch on the motor when the clamping lever is not in the clamped lever.

In an additional development of the invention, a second recess into which a second projection of the link rod, extending in the lengthwise direction of the link rod, can be inserted in the clamped position, is provided at the free end of the clamping lever.

With this feature the interlocking elements can be designed with low strength, since because of the lever effect much lower retaining forces are required at the free end of the clamping lever in order to keep the clamping lever from moving into the released position. This is particularly advantageous when the link rod is made not of metal but of a plastic material.

Since the switch to switch the motor on and off is preferably located at the end of the power tool opposite the quick clamping device, the link rod must be guided in the motor housing past the motor and the fan to the end of the clamping lever, at which it is pivotably fastened. For this reason it is preferable to manufacture the link rod, at least in the front region facing the quick clamping device, from an electrically insulated material, in particular from plastic.

In a further embodiment of the invention, a projection that extends substantially perpendicularly from the second recess and, with the clamping lever in a position pivoted only slightly with respect to the clamped position, blocks the second projection of the link rod to prevent advancement of the link rod into the activated setting, is provided at the free end of the clamping lever.

Thus activation of the motor is prevented even with only a slight overlap of the first recess and the first projection, and the second recess and the second projection, i.e. when the clamping lever is pivoted only slightly out of the clamped position. Improper operation is practically completely excluded in this manner. Interlock reliability is considerably improved by interlocking both in the lengthwise direction of the link rod and in a direction perpendicular thereto.

In a further advantageous embodiment of the invention, the link rod is configured in multiple parts.

The advantage of this feature is that installation of the link rod is considerably simplified, since a front part facing the quick clamping device can be introduced through the motor housing and can then be joined to a rear part by means of which the switch is actuated.

In a preferred development of this embodiment, the link rod has a front and a rear part, which can be snap-locked together.

In this manner the two parts can be joined in a particular simple way.

In a further embodiment of the invention, a slider that is joined in a snap-lock fashion to the link rod is provided outside the motor housing to displace the link rod.

The link rod to actuate the switch can thus easily be actuated from outside by displacing the slider.

In a further preferred embodiment of the invention, provision is made to push the link rod elastically via a spring element in the direction of the deactivated setting.

The advantage of this feature is that movement of the link rod into the deactivated setting is assisted.

In an additional development of the invention, a brake disk that, with the clamping lever in the released position, interacts as a braking device to decelerate the hollow spindle, is provided opposite the end surface of the hollow spindle facing the clamping lever.

Thus on the one hand a tool that is still coasting is immediately decelerated as soon as the clamping lever is released after the motor is switched off, and on the other hand frictionally engaged locking of the hollow spindle in the released position of the clamping lever is achieved, so that subsequent manual changing of the tool is facilitated. Since a tool that is still coasting is decelerated when the clamping lever is opened, the risk of accident is further reduced by this feature.

In a preferred development of the invention, a pusher plate is arranged on the pusher element and joined positively to the hollow spindle, the surface of the pusher plate facing the pusher stud being configured as a friction surface.

The advantage of this feature is that with the movement of the clamping lever into the released position, at the same time the tension spindle is displaced in the axial direction and braking occurs, relative rotation between tension spindle and hollow spindle being excluded, so that any possible release of the tension spindle with respect to the hollow spindle is eliminated in all cases because of the braking process.

With this embodiment it is advantageous if, in addition, the pusher stud is also fastened positively in the gear drive housing.

As a result, rotation of the pusher stud during the braking process as a result of braking torque is prevented, ensuring a reliable braking process.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

A preferred exemplary embodiment of the invention is explained in greater detail below with reference to the drawings, in which.

DESCRIPTION OF THE PREFERRED EMBODIMENT

Figure 1:
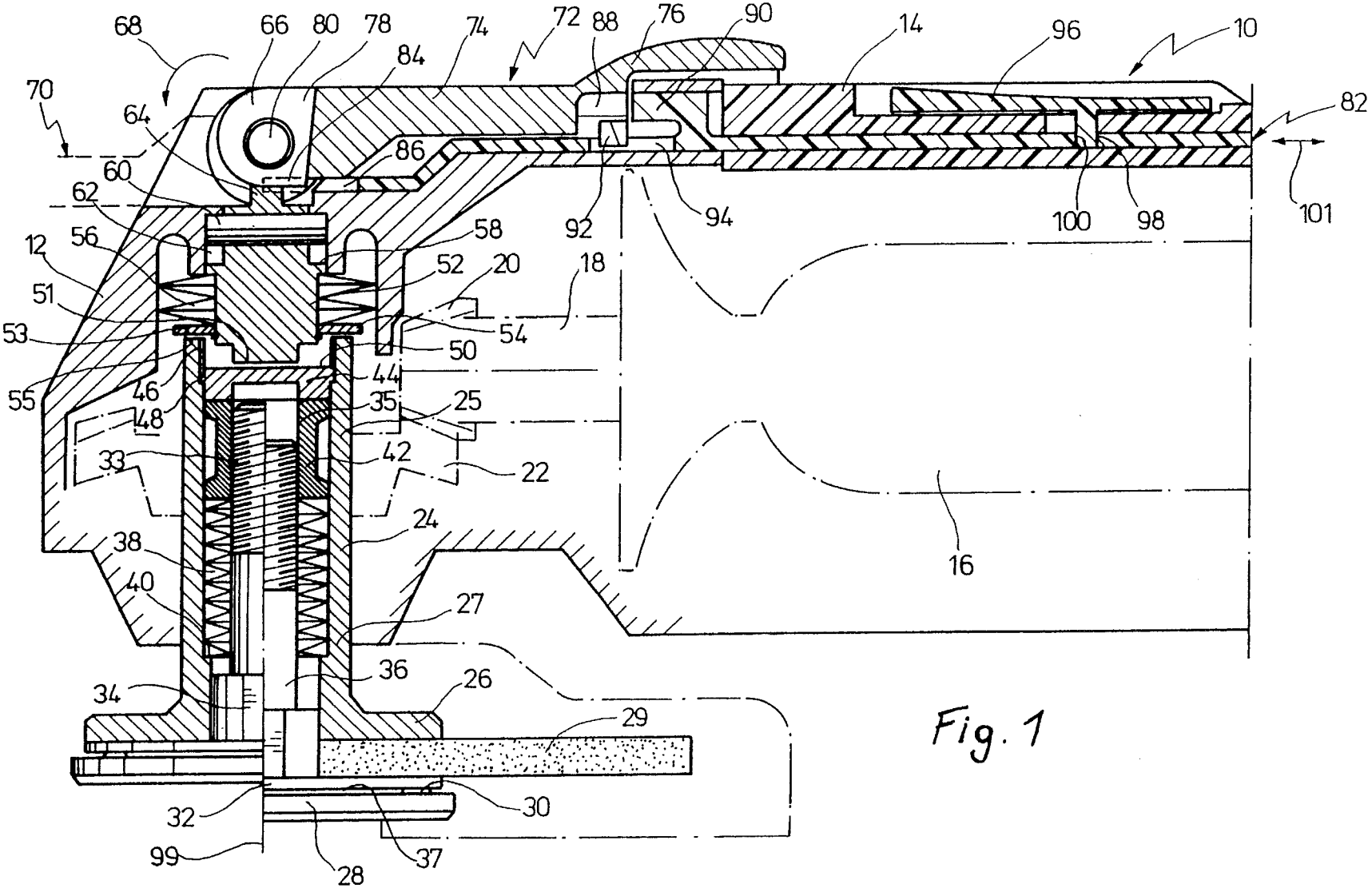
FIG. 1 shows a simplified lengthwise section through a power tool according to the invention.

In FIG. 1, an exemplary embodiment of the invention is labeled in its entirety with the number 10. The power tool 10 comprises an electric motor 16, arranged inside a motor housing 14, the motor shaft 18 of which, projecting into the adjacent gear drive housing 12, drives a pinion 20 of a bevel gear drive, the output gear 22 of which drives a hollow spindle 24 mounted in the gear drive housing 12. One end of the hollow spindle 24 projects outward from the gear drive housing 12 and is configured as a counterflange 26 with which is associated an external clamping flange 28 to clamp a tool 29 located between them, which in the example shown is a grinding disk. A quick clamping device which has a tension spindle 36, coaxial with the hollow spindle 24, that is joined integrally to the clamping flange 28 is provided in order to allow manual clamping-and unclamping of the tool 29.

The tension spindle 36 can be displaced in the axial direction by means of a displacement unit via a clamping lever 74 that can pivot about an axis 80.

The hollow spindle 24 has a first section 25 within which is arranged a pusher plate 44 that is held nonrotatably on the hollow spindle 24 by two brackets 48 engaging laterally in grooves 46 of the hollow spindle 24. The pusher plate 44 is braced against a pusher element 42 lying below it.

Adjoining the first upper section 25 of the hollow spindle 24 is a second section 27 of the hollow spindle, forming an internal shoulder 40. Enclosed between the pusher element 42 and internal shoulder 40 are spring elements 38 by means of which the pusher element 42 is pushed upward in the direction of the pusher plate 44. The pusher element 42 has internal threads 35 into which the tension spindle 36 can be threaded with external threads 33 provided at its upper end.

Arranged between the tool 29 and the outer clamping flange 28 is an intermediate flange 32 that projects by means of a polygon 34 into the second section 27 of the hollow spindle 24, in order to lock the intermediate flange 32 positively on the hollow spindle 24. Arranged between the intermediate flange 32 and the outer clamping flange 28 is a spring washer 37 that is depicted in the right half of the tension spindle 36, compressed between the intermediate flange 32 and the counterflange 38. Positive engagement elements 30, which can for example be configured as claws engaging in corresponding depressions or as end serrations, are provided between the intermediate flange 32 and the counterflange 28.

Once positive engagement is produced in this way between the intermediate flange 32 and the counterflange 28, the counterflange 28 is therefore also fastened, positively and therefore nonrotatably, to the hollow spindle 24 by means of the polygon 34 engaging positively into the hollow spindle 24.

In the position depicted [in the] right half of the hollow spindle 24, the tool is thus held between the two flanges 26, 28 or the intermediate flange 32 located between them; the tension spindle 36, joined by threading to the pusher element 42, generates, by means of the spring elements 38 enclosed between them, an axial tension by means of which the flanges 26, 32, 28 are pressed together, so that the tool 29 is nonrotatably clamped.

To allow manual changing of the tool 29, the tension spindle 36 can be pivoted outward, by pivoting the clamping lever 74 from a clamping position 72, in which the clamping lever 74 lies against the gear drive housing, outward and away from the gear drive housing 12 in the direction of the arrow 68 into a released position indicated by the number 70. Provided at its first end 78, at which the clamping lever 74 is pivotably fastened to the shaft 80, is an eccentric element 66 against which rests, via a cam lobe 64, a pusher stud 52 which is pushed via spring elements 56 toward the eccentric element 66. The spring elements 56 are clamped between a shoulder 58 of the pusher stud 52 and a disk 54 that is movable in the gear drive housing 12 and, in the clamped position 72, is held against the pusher stud 52 by a snap ring at a distance from the hollow spindle 24. The disk 54 is configured as a brake disk, since its underside, which is configured as a friction surface 53, is pressed upon displacement of the pusher stud 52 toward the pusher plate 44 by the pressure of the spring elements 56 onto the end surface 55 of the hollow spindle 24 in order to decelerate the latter.

With the clamping lever 74 in the clamped position 72 as illustrated, the pusher stud 52 has its cam lobe 64 resting against the eccentric element, so that the lower end surface of the pusher stud 52, which is configured as an additional friction surface 51 facing the pusher plate 44 lying below it, is lifted by the surface of the pusher plate 44 that is also configured as a friction surface 50.

If the clamping lever 74 is then pivoted in the direction of the arrow 68 out of the clamped position 72 into the released position 70, the pusher stud 52 is then displaced, by means of the cam lobe 64 resting against the eccentric element 66, downward toward the pusher plate 44. As a result, firstly the disk 54 is pressed against the end surface 55 of the first section 25 of the hollow spindle 24, so that the hollow spindle 24 is decelerated in response to the spring elements 56. Additional deceleration occurs by the fact that as the pusher element 52 is pushed farther downward as the clamping lever 74 moves into the released position 70, the two friction surfaces 50, 51 are also pressed together.

The result of a positive connection 46 between pusher plate 44 and hollow spindle 24 is to prevent relative rotation between them. Simultaneously, the axial displacement of the pusher plate 44 causes the tension spindle 36, that is threaded together with the pusher element 42 located below it, to be displaced outward, so that the clamping flange 28 is lifted away from the intermediate flange 32 and the positive lock 30 between the intermediate flange 32 and the clamping flange 28 is abolished.

In this position, the clamping flange 28 can then be manually rotated, without the aid of a tool, in order to unscrew the tension spindle 36 out of the pusher element 42 and allow the tool to be changed. Once a new tool has been inserted, the clamping flange 28, with the tension spindle 36 rigidly joined thereto, is once again screwed as far as possible into the pusher element. Then the clamping lever 74 is moved back into the clamping position 72, as a result of which positive locking 30 occurs between the intermediate flange 32 and the clamping flange 28, and therefore the clamping flange 28 is also positively secured against rotation on the hollow spindle 24 by means of the polygon 34 of the intermediate flange 32, and the tool 29 is nonrotatably clamped between the flanges 26, 32, 28.

In the clamped position 74, the friction surface 51 of the pusher stud 52 is also lifted away from the friction surface 50 of the pusher plate 44 so that the frictionally engaged locking of the hollow spindle 24, which occurs with the clamping lever 74 in the released position 70, is abolished and the hollow spindle 24 can thus, in the clamped position, be driven in order to drive the tool 29.

The pusher stud 52 is positively secured against rotation to the machine housing 12 by a transverse stud 60, which passes through a transverse bore of the pusher stud 52 and is held in axially displaceable fashion in two opposing grooves 62 of the machine housing 12.

The motor 16 can be switched on and off by means of a switch 110 (cf. FIG. 3) that can be actuated by a link rod 82 which extends parallel to the motor shaft 18 perpendicular to the axial direction 99 of the hollow spindle 24. The link rod 82 is guided next to the motor 16 in the motor housing 14 and in the gear drive housing 12, and can be displaced in the lengthwise direction 101 of the link rod 82 by means of an external slider 96, which is fastened in snap-locked fashion, with a projection 100, in an opening 98 of the link rod 82.

With the link rod 82 in the position shown in FIG. 1, in which the link rod is in its position remote from the shaft 80 of the clamping lever 74, the switch 110 and thus the motor 16 are turned off.

However, when the link rod is displaced out of the deactivated position shown in FIG. 1 toward the axis 80 of the clamping lever 74, the switch 110 is actuated and the link rod is located in an activated position shifted toward the axis 80 (if the movement of the switch 110 is controlled in the usual manner by a cardioid mechanism, the link rod is displaced from the position advanced maximally toward the axis 80, under the action a spring 118 that is located on the switch 110, slightly back toward the deactivated position).

Firstly to ensure that with the link rod 82 in the activated position, the clamping lever 74 cannot be pivoted out of the clamped position 72 in the direction of the arrow 68, and secondly to allow the motor 16 to be switched on only when the clamping lever 74 is in its clamped position 72, the link rod 82 has at its end facing the axis 80 two first projections 86 (cf. FIGS. 2 to 4), with which are associated corresponding first recesses 84 in the first end 78 of the clamping lever 74, into which the first projections 86 can be slid when displaced in the lengthwise direction 101.

In addition, the clamping lever 74 has in the region of its free end 76 a second recess 88 into which a second projection 90, projecting from the link rod 82 in the lengthwise direction 101, can be slid when the clamping lever 74 is in its clamped position 72.

Provided beneath the second recess 88 of the clamping lever 74 is a projection 92 that extends downward perpendicular to the orientation of the second recess 88 and thus projects toward the gear drive housing 12.

Figure 2:
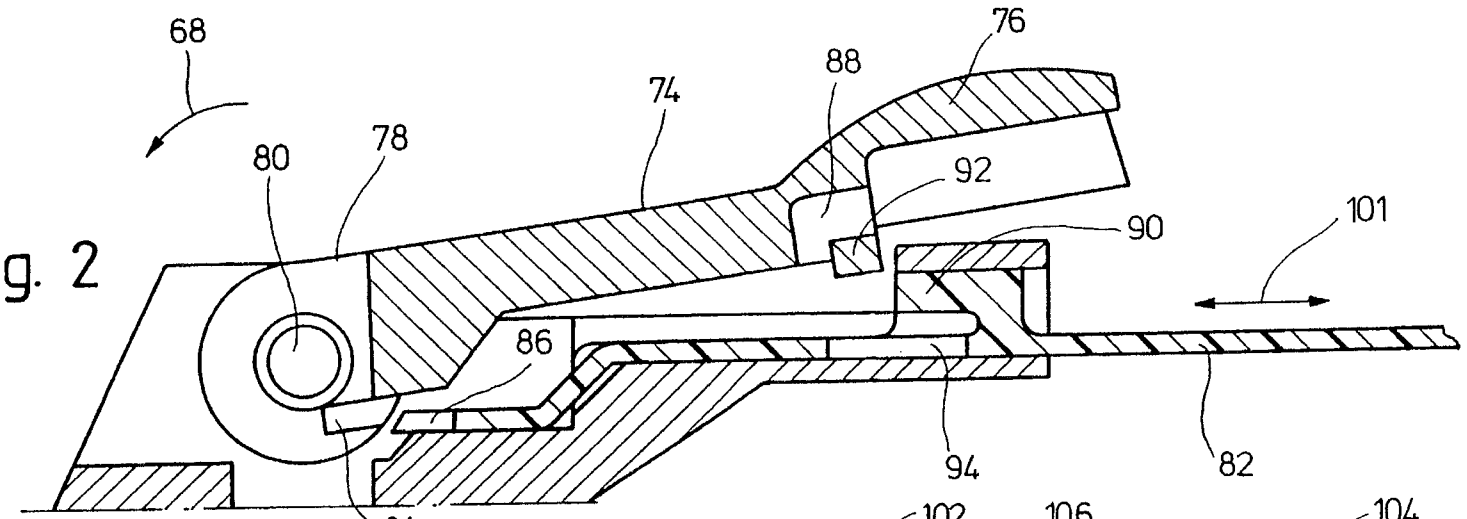
FIG. 2 shows an enlarged partial depiction of the power tool according to the invention, in which only the clamping lever, pivoted slightly out of the clamping position, and the front region of the link rod are visible.

In the power tool according to the invention, activation of the motor 16 by displacement of the link rod 82 in the lengthwise direction 101 is prevented if the clamping lever 74 is pivoted even slightly out of the clamped position 72 shown in FIG. 1 into a slightly open position (cf. FIG. 2).

This is achieved by a combination of the first openings 84 of the clamping lever 74, which interact with the first projections 86 of the link rod 82; the second recess 88 which interacts with the second projection 90 of the link rod 82; and the projection 92, which prevents the link rod 82 from advancing, in the position shown in FIG. 2, toward the axis 80.

Although the projection 92 is not absolutely necessary to achieve secure interlocking of the clamping lever 74 in the clamped position, in order to prevent opening of the clamping lever 74 when the motor is switched on, the additional projection 92 on the clamping lever 74 prevents the link rod 82 from being advanced into the activated position if the clamping lever 74 is pivoted even very slightly out of the clamped position 72 shown in FIG. 1. In addition, this projection 92 prevents the link rod 82 from being moved forward if the projections 86 are damaged by wear and the clamping lever 74 is slightly raised.

In the clamped position 72 shown in FIG. 1, the projection 92 of the clamping lever 74 engages into a groove 94 of the clamping lever 74 (cf. FIGS. 3 and 4), so that the clamping lever 74 is pivoted in completely against the motor housing 14 and in this position, the link rod 82 can be moved in the lengthwise direction 101 into the activated position.

Figure 3:
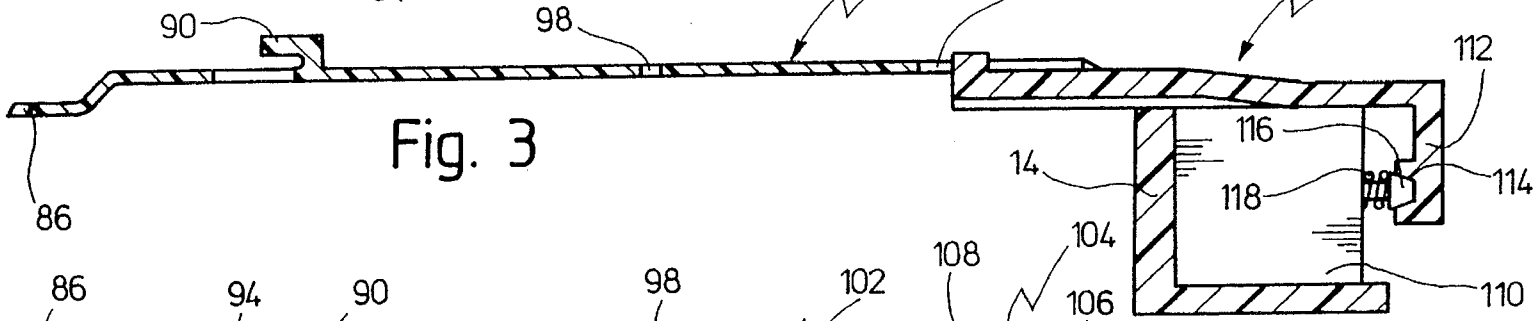
FIG. 3 shows a lengthwise section through the link rod, with the associated switch at its rear end.
Figure 4:
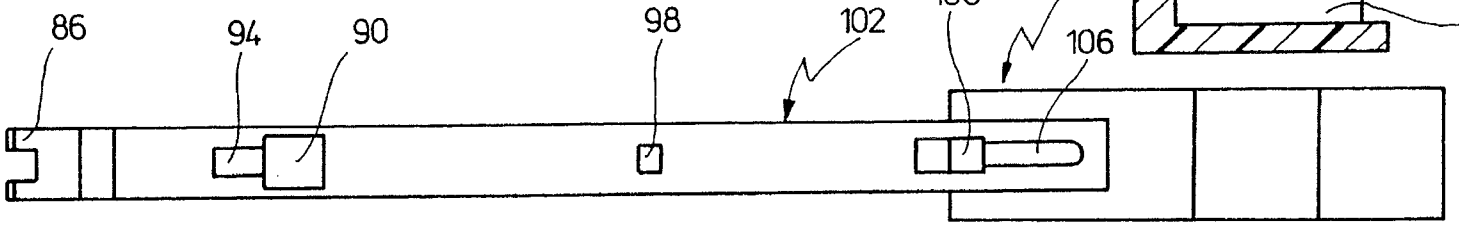
FIG. 4 shows a top view of the link rod according to FIG. 3, but without the associated switch.

As may now be gathered from FIGS. 3 and 4, the link rod 82 is configured in two parts. It consists of a front part 102, facing the axis 80, which is connected in snap-lock fashion to a rear part 104 by means of a snap-lock element 108 which engages in a slot 106 of the front part 102. This facilitates assembly of the link rod 82. The front part 102 of the link rod can be pushed from the rear through the motor housing 14, past the fan for the motor 16, into the gear drive housing 12, in which it is laterally guided in a manner not shown further. The rear part 104 of the link rod can then be snap-locked to the front part 102 and thus attached thereto. The link rod 82 is also laterally guided in the motor housing 14, in a manner not depicted. The rear part 104 of the link rod has an end 112, bent at a right angle, in which a receptacle 114 is provided into which a switch pin 116 of the switch 110 engages. The switch pin 116 is also pushed by the spring 118 toward the deactivated position. As a result, the entire link rod 82 is pushed toward the deactivated position, so that even a slight displacement of the slider 96 in a direction away from the axis 80 is sufficient to move the link rod 82 into the deactivated position and actuate the switch 110 to switch off the motor 16.

With the link rod 82 in the deactivated position shown in FIGS. 1 and 2, the clamping lever 74 can then be pivoted in the direction of the arrow 68 in order to open the quick clamping device, as a result of which a tool 29, still coasting after the motor 16 has previously been switched off, is simultaneously decelerated, since the two friction surfaces 50, 51 are pressed against one another by displacement of the pusher stud 52 by the eccentric element 66. When the clamping lever 74 has been pivoted completely into the released position indicated with the number 70 in FIG. 1, the hollow spindle 24, as described earlier, is locked by frictional engagement, and the tool 29 can be replaced in the manner described earlier.

Only when the clamping lever 74 has again been moved completely into the clamped position 72, so that a tool 29 just inserted is firmly clamped, can the link rod 82 be moved back into its activated position in order to switch on the motor. When the motor 16 is switched on, opening of the clamping lever 74 is not possible because it is interlocked with the link rod 82.

Both the front part 102 and the rear part 104 of the link rod 82 are made of an insulating material, preferably a fiber-reinforced plastic.

We claim:

1. Power tool, comprising a hollow spindle driven by a motor, a quick clamping device to receive a tool between a clamping flange and a counterflange, wherein the quick clamping device includes a tension spindle, coaxial with the hollow spindle, that is tensioned in an axial direction by means of elastic elements and is displaceable in the axial direction relative to the hollow spindle, by means of a clamping lever, between a clamped position in which the tool is nonrotatably retained between the flanges, and a released position in which the flanges are disengaged in the axial direction for manual changing of the tool; and further comprising a switch movable into an activated position to actuate the motor, and a link rod arranged between said clamping lever and said switch and engaging said switch and said clamping lever so that said clamping lever is blocked against movement into said released position when said switch is in its activated position.

2. Power tool according to claim 1, wherein said link rod blocks said switch against movement into its activated position, when said clamping lever is in the released position.

3. Power tool according to claim 1, wherein the link rod is displaceable in a lengthwise direction between an activated position in which the switch is activated and a deactivated position, wherein at least one locking element is arranged between said link rod and said clamping lever, which in the activated position is interlocked with a counterelement.

4. Power tool according to claim 1, wherein the clamping lever is pivotably mounted at a first end about an axis and comprises an eccentric element which acts via a pusher stud on a pusher element in order to displace the tension spindle in the axial direction between said clamped position and said released position as the clamping lever pivots.

5. Power tool according to claim 4, wherein a first end of the clamping lever comprises at least a first recess adapted to receive a projection of the link rod when moving said link rod in its lengthwise direction for interlocking the clamping lever in the clamped position.

6. Power tool according to claim 5, wherein said clamping lever comprises a second end which is pivotable about said first end and comprises a second recess on said second end adapted to receive a second projection, projecting from said link rod in the lengthwise direction thereof.

7. Power tool according to claim 6, wherein said clamping lever comprises a projection extending substantially perpendicularly from the second recess thereof and, with the clamping lever in a position pivoted only slightly with respect to the clamped position, blocking the second projection of the link rod to prevent advancement of the link rod into an activated position, in which said switch is activated.

8. Power tool according to claim 1, wherein the link rod is configured in multiple parts.

9. Power tool according to claim 8, wherein the link rod comprises a front part facing the quick clamping device, and a rear part, which can be snap-locked with said front part.

10. Power tool according to claim 9, wherein at least said front part of said link rod is made of an electrically insulating material.

11. Power tool according to claim 8, which further comprises a motor housing and a slider projecting therefrom and being joined in a snap-lock fashion to the link rod.

12. Power tool according to claim 1, wherein said link rod is spring-biased via a spring element into the direction of a deactivated position in which said clamping lever is blocked against movement.

13. Power tool according to claim 4, comprising a brake disk which is arranged opposite an end surface of the hollow spindle which faces the clamping lever, said brake disk being adapted to decelerate said hollow spindle when said clamping lever is in the released position.

14. Power tool according to claim 13, wherein a pusher plate is arranged on said pusher element and joined positively to said hollow spindle, a surface of said pusher plate facing said pusher stud being configured as a friction surface.

15. Power tool according to claim 13, comprising a gear drive housing, wherein said pusher stud is fastened positively to prevent rotation.

* * * * *